US009982911B2

(12) United States Patent
Dowling et al.

(10) Patent No.: US 9,982,911 B2
(45) Date of Patent: May 29, 2018

(54) ELECTRICAL HEATING DEVICE

(71) Applicant: BorgWarner Ludwigsburg GmbH, Ludwigsburg (DE)

(72) Inventors: Martin Dowling, Tralee Co. Kerry (IE); Peter Mitchell, Tralee Co. Kerry (IE); Gearoid Pierce, Tralee Co. Kerry (IE); George McCarthy, Tralee Co. Kerry (IE); Kevin Dukes, Tralee Co. Kerry (IE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 254 days.

(21) Appl. No.: 14/882,005

(22) Filed: Oct. 13, 2015

(65) Prior Publication Data

US 2016/0109153 A1 Apr. 21, 2016

(30) Foreign Application Priority Data

Oct. 15, 2014 (DE) ..... 10 2014 114 983

(51) Int. Cl.
*F24H 3/04* (2006.01)
*H05B 3/44* (2006.01)

(52) U.S. Cl.
CPC ..... *F24H 3/0435* (2013.01); *H05B 3/44* (2013.01); *H05B 2203/023* (2013.01)

(58) Field of Classification Search
CPC ..... H05B 3/06; F24H 3/0405; F24H 3/0435; F24H 3/0464; F24H 3/0429; F24H 3/0441; F24H 3/0476; F24H 3/0447; F24H 9/1872
USPC ..... 219/530, 540, 542
See application file for complete search history.

(56) References Cited

U.S. PATENT DOCUMENTS

| | | | | |
|---|---|---|---|---|
| 5,192,853 | A * | 3/1993 | Yeh | H05B 3/06 219/505 |
| 2003/0160043 | A1* | 8/2003 | Clemens | F24H 3/0405 219/530 |
| 2007/0095809 | A1* | 5/2007 | Lee | B60H 1/2225 219/222 |
| 2008/0073336 | A1 | 3/2008 | Bohlender et al. | |
| 2009/0139983 | A1 | 6/2009 | Luppold et al. | |
| 2012/0261403 | A1 | 10/2012 | Luppold et al. | |
| 2014/0097179 | A1 | 4/2014 | Conway et al. | |

FOREIGN PATENT DOCUMENTS

| | | | |
|---|---|---|---|
| DE | 10 2006 018 784 | A1 | 6/2007 |
| DE | 10 2011 017 376 | A1 | 10/2012 |
| DE | 10 2012 109 801 | A1 | 4/2014 |
| EP | 1 327 834 | A1 | 7/2003 |
| WO | WO 2012/016687 | A1 | 2/2012 |

* cited by examiner

*Primary Examiner* — Brian Jennison
(74) *Attorney, Agent, or Firm* — Bose McKinney & Evans LLP

(57) ABSTRACT

This disclosure refers to an electrical heating device comprising a heating rod, and heat sinks which are held between opposing flanges of the heating rod. The heat sinks are clamped by the flanges pressing laterally against the heat sinks.

11 Claims, 2 Drawing Sheets

ELECTRICAL HEATING DEVICE

RELATED APPLICATIONS

This application claims priority to DE 10 2014 114 983.1, filed Oct. 15, 2014, the entire disclosure of which is hereby incorporated herein by reference in its entirety.

BACKGROUND

The present invention refers to an electrical heating device comprising at least one heating rod and heat sinks attached to the heating rods. Such electrical heating devices are known from DE 10 2012 109 801 A1 and are used for heating the interior of automotive vehicles. The heating devices heat a stream of air that passes their heat sinks and is blown into the interior of a car.

The heating device known from DE 10 2012 109 801 A1 comprises heating rods and corrugated sheets as heat sinks which are held between flanges of the heating rod. Flange sections defined by cuts in the flanges are bent to grip and hold the heat sinks.

SUMMARY

This disclosure teaches how an electrical heating device allowing efficient heating of the interior of a car can be produced at lower cost.

According to this disclosure the heating rods have flanges that hold the heating rods. The flanges run in the longitudinal direction of the heating rods. Each heat sink is placed between two such flanges. In order to hold the heat sinks in place, the flanges are bent towards each other so that they press laterally against the heat sinks. Thus the heat sinks are clamped by the flanges.

The heat sinks may be corrugated sheet metal. Corrugated sheet metal can provide a meandering heat sink with a series of valleys and ridges at low cost. This allows for a large contact area with air flowing through the valley. Heat sinks of corrugated sheet metal are preferably placed between flanges of a heating rod such that the flanges are adjacent to the edges or narrow sides of the metal sheet. Instead of corrugated sheet metal it is also possible to use extruded or cast heat sinks, for example.

The flanges are preferably bent towards each other substantially along their whole length or the whole length of the heat sinks.

Preferably the heating rod is covered between the flanges with a filler material connecting the heat sinks to the heating rod. The filler material improves the flow of heat form the heating rod to the heat sinks by providing a good thermal contact. The filler material may be an adhesive or a heat sink past.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DESCRIPTION

Figure 3:
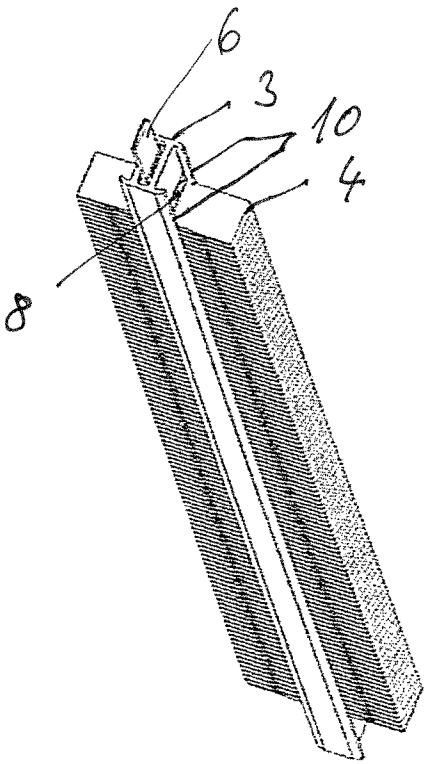
FIG. 3 shows a detail of FIG. 1.

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

The heating device comprises a plurality of heating rods 3 and heat sinks 4. The heating rods may be tubes which contain at least one heating resistor, for example a PTC element. A front end of the heating rods 3 is stuck in a holder 1, a rear end in a holder 2.

The front end of the heating rods 3 is used for electrical connection. A contact sheet 6 protrudes form the front end of the heating rods 3. This contact sheet 6 contacts the heating resistor or resistors of the heating rod 3 and is electrically isolated from a surrounding housing. In the embodiment shown, the tube housing of the heating rods 3 is used for ground connection. The heating rods 3 are therefore stuck through a metal contact sheet 5 that may be arranged at an underside of the holder 1. It is also possible to provide a second contact sheet for each heating rod 1 that protrudes from the front end of the housing like contact sheet 6.

As FIG. 3 shows, the heat sinks 4 are held between flanges 10 of the heating rods 3. The flanges 10 run continuously in the longitudinal direction of the heating rod 3 and clamp the heat sinks 4 arranged between opposing flanges 10. In the embodiment shown, the flanges press laterally against the heat sinks 4 along the entire length of the heat sinks. The manufacturing process is easier if the flanges are bent inwards along their entire length, although the heat sinks 4 can also be held securely if only a shorter section of the flanges 10 is bent inward to clamp the heat sinks 4.

The flanges 10 may be pressed against the heat sinks 4 so much that the heat sinks 4 are plastically deformed, for example that the flanges 10 cause indentions in the heat sinks 4. The flanges 10 are bent inwards by an angle of preferably less than 30°.

The heat sinks 4 may be corrugated sheet metal, for example of aluminium. The flanges 10 on each lateral edge of the heating rods 3 are continuous, i.e. not cut into sections.

Between the flanges 10 the heating rod 3 is covered with a filler material 8 which improves thermal contact between the heat sinks 4 and the heating rod 3. The filler material may be an adhesive or a heat sink paste, for example.

Figure 1:
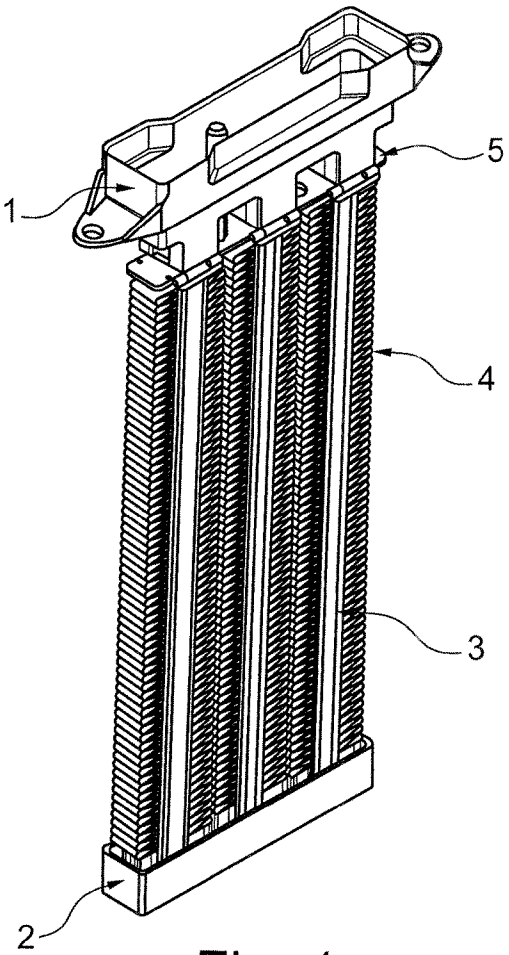
FIG. 1 shows an electrical heating device.
Figure 2:
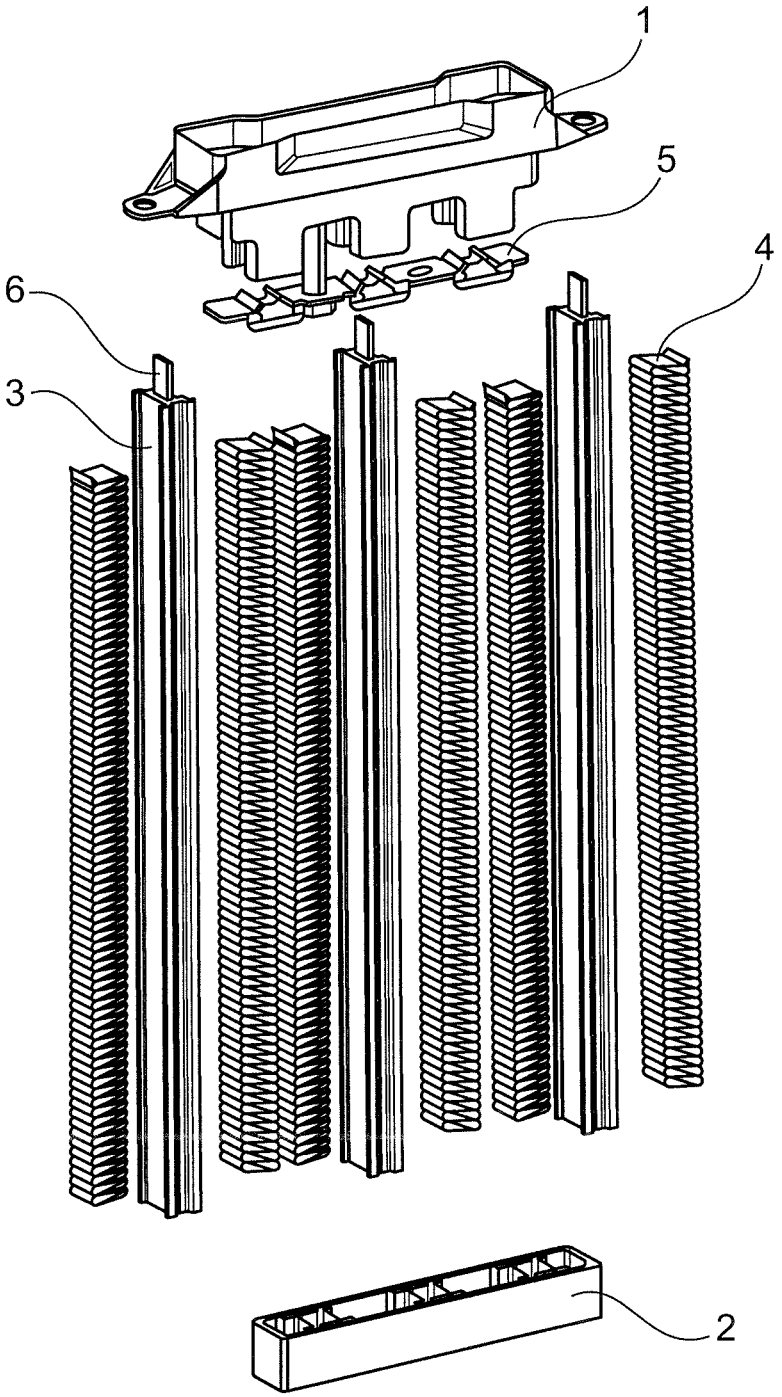
FIG. 2 shows an exploded view of the heating device.

A heating device like the embodiment shown in FIG. 1 can be manufactured by providing a heating rod 3 comprising flanges 10 that run in longitudinal direction of the heating rod 3. A heat sink 4 is then placed between two such flanges 10 and fixed to the heating rod 3 by crimping. That is, by bending the flanges 10 towards each other so that they press laterally against the heat sinks 4. The flanges 10 can be bent inwardly with such force that they indent the heat sinks 4. In this case the heat sinks are plastically deformed by the flanges. The flanges 10 can then hold the heat sinks 4 by a combination of clamping and a positive fit of the flanges 10 in the indentions. It also possible that the flanges 10 do not cause a deformation of the heat sinks 4 and hold them only by clamping.

The heating rod 3 can be provided by producing a tube housing that has flanges 10 and then placing one or several heating resistors in the tube housing. The tube housing can be made by bar extrusion as described in DE 10 2006 018 784 A1. The resistor or resistors can be placed in the tube housing together with a contact sheet 5 and an insulation layer for insulating the contact sheet from the housing. The tube housing can be compressed for improving thermal contact between the housing and the resistor or resistors.

Preferably any compression step is done before the heat sinks 4 are attached to the heating rod 3.

The contact sheet 5 has a contact side contacting the heating resistor or resistors. Preferably this contact side faces a heating rod side on which a heat sink 4 is placed. For compressing, force can be applied between the flanges. The heating resistors may be ceramic PTC heating elements, for example made of barium titantate.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

What is claimed is:

1. Electrical heating device, comprising:

a heating rod configured for holding one or more heating resistors, the heating rod formed from a tube housing having opposing flanges that are integral with the tube housing; and a heat sink which is held between the opposing flanges;

wherein the heat sink is clamped by the flanges pressing laterally against the heat sink.

2. Electrical heating device according to claim 1, wherein the heat sink is formed from corrugated sheet metal.

3. Electrical heating device according to claim 2, wherein the flanges press against edges of the sheet metal.

4. Electrical heating device according to claim 1, wherein the heating rod is covered between the flanges with a filler material thermally connecting the heat sink to the heating rod.

5. Electrical heating device according to claim 4, wherein the filler material is an adhesive or a heat sink paste.

6. Electrical heating device according to claim 1, wherein the heat sink is plastically deformed by the flanges pressing against them.

7. Electrical heating device according to claim 1, wherein the heat sink has indentations in locations of contact with the flanges.

8. Electrical heating device according to claim 1, wherein the flanges press laterally against the heat sink substantially along the entire length of the heat sink.

9. Electrical heating device according to claim 1, wherein the heat sink has indentions caused by the flanges pressing against the heat sink.

10. Electrical heating device according claim 1, wherein the heating rod comprises a plurality of heating rods arranged side by side and the heat sink comprises at least two heat sinks arranged between the heating rods.

11. Electrical heating device, comprising:

a heating rod configured for holding one or more heating resistors, the heating rod having two opposite sides and a pair of opposing flanges arranged on each side; and each pair of the opposing flanges holding a heat sink therebetween;

wherein each pair of the opposing flanges presses laterally against and clamps the respective heat sink.

* * * * *